United States Patent [19]

Sakaki

[11] 4,071,076

[45] Jan. 31, 1978

[54] SEALING MEMBER FOR A ROTARY HEAT-ACCUMULATOR TYPE HEAT EXCHANGER FOR A GAS TURBINE ENGINE

[75] Inventor: Yoshihiro Sakaki, Suwa, Japan

[73] Assignee: Nissan Motor Co., Ltd., Yokohama, Japan

[21] Appl. No.: 678,652

[22] Filed: Apr. 20, 1976

[30] Foreign Application Priority Data

Apr. 21, 1975 Japan ..... 50-47580

[51] Int. Cl.[2] ..... F28D 19/04

[52] U.S. Cl. ..... 165/9; 277/74; 277/81 R; 277/92; 277/227

[58] Field of Search ..... 165/9; 277/92, 227, 277/74, 84, 81 R, 173, 27

[56] References Cited

U.S. PATENT DOCUMENTS

| | | | |
|---|---|---|---|
| 3,262,707 | 7/1966 | Williams | 165/9 X |
| 3,368,611 | 2/1968 | Bracken, Jr. et al. | 165/9 X |
| 3,931,852 | 1/1976 | Rao | 165/9 |
| 3,957,106 | 5/1976 | Whitfield | 165/9 |
| 3,977,464 | 8/1976 | Mai | 165/9 |
| 3,977,465 | 8/1976 | Tank | 165/9 |

FOREIGN PATENT DOCUMENTS

| | | | |
|---|---|---|---|
| 1,054,557 | 2/1954 | France | 165/9 |

*Primary Examiner*—Charles J. Myhre
*Assistant Examiner*—Sheldon Richter
*Attorney, Agent, or Firm*—Lowe, King, Price & Markva

[57] ABSTRACT

A sealing member for a rotary heat-accumulator type heat exchanger for a gas turbine engine, in which a hollow cover having a plurality of holes is provided between a sliding plate and a shield panel of a heat accumulator. Low-temperature, high pressure air is forced to flow through the holes of the cover into high-temperature air side of the heat accumulator, whereby portions of the sealing member are effectively cooled.

7 Claims, 6 Drawing Figures

SEALING MEMBER FOR A ROTARY HEAT-ACCUMULATOR TYPE HEAT EXCHANGER FOR A GAS TURBINE ENGINE

BACKGROUND OF THE INVENTION

This invention relates to gas turbine engines and, more particularly, to a rotary heat-accumulator type heat exchanger for such engines adapted to effectively cool portions of the sealing means of the heat exchanger.

As is well know, a sealing means of the prior art for a rotary heat-accumulator type heat exchanger of a gas turbine engine generally comprises a sliding plate, a shield panel and a backing plate to effect separation of the flows of low temperature, high-pressure air and of high-temperature, low pressure exhaust gases. A drawback is encountered with this prior art in that the temperature of a portion of the sealing means is raised to an excessive high level during operation of the gas turbine engine due to inherent construction of the sealing means and, thus, a heat resisting layer formed on the sliding plate is caused to be separated therefrom.

It is therefore an object of the present invention to provide an improved sealing member for a rotary heat-accumulator type heat exchanger of a gas turbine engine.

It is another object of the present invention to provide an improved sealing member for a rotary heat-accumulator type heat exchanger which is provided with a cooling means by which the sealing member is effectively cooled.

It is still another object of the present invention to provide an improved sealing member which is simple in construction and easy to manufacture.

BRIEF DESCRIPTION OF THE DRAWINGS

These and other objects, features and advantages of the present invention will become more apparent from the following description when taken in conjunction with the accompanying drawings, in which.

DESCRIPTION OF THE SPECIFIC EMBODIMENTS

Figure 1:
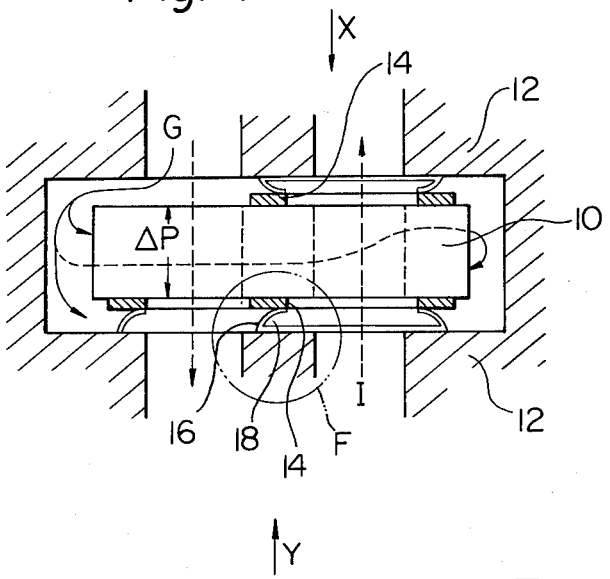
FIG. 1 is a cross sectional view of a rotary heatacumulator type heat exchanger to which the present invention is directed.
Figure 2:
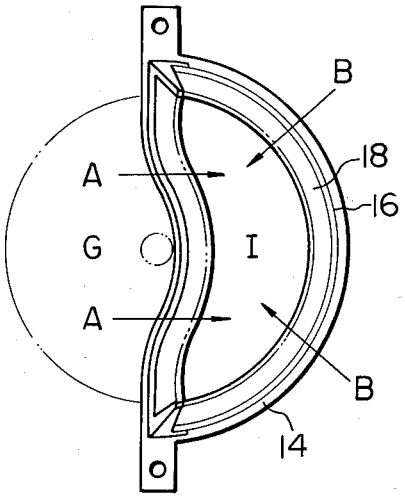
FIGS. 2 and 3 are elevational views of sealing members seen from the arrows X and Y, respectively, in FIG. 1.
Figure 3:
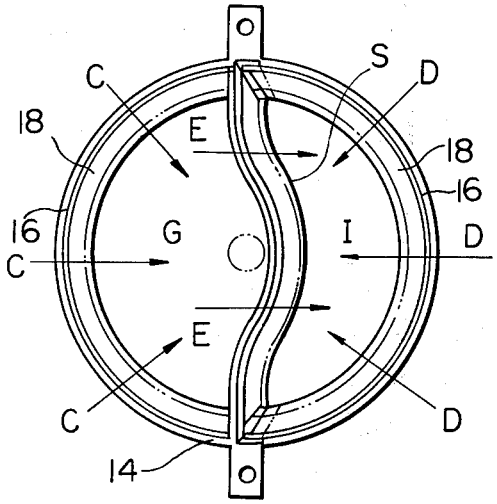

Referring now to FIGS. 1 to 3, there is shown a conventional rotary heat-accumulator type heat exchanger for a gas turbine. The heat exchanger comprises a heat accumulator 10, stationary walls 12 of the heat exchanger, a sliding plate 14, a shield panel 16, and a backing plate 18. The flow paths G indicate how air enters the heat exchanger and the flow path I indicates how low-pressure gases are exhausted.

FIGS. 2 and 3 depict the low-temperature side (seen from X) and the high-temperature side (seen from Y) of the sealing means of FIG. 1, respectively. Letters A,B,C,D and E illustrate paths for leakage of air from the high-pressure side to the low-pressure side through the space between sliding plate 14 and the adjacent surfaces of heat accumulator 10. Of these, however, flows A, B, C and D have the effect of cooling the sliding parts since the leaking high-pressure air is at a low temperature. This cooling process results in the prevention of high-temperature abrasion of the sliding plate and of the break-away of a heat resisting layer from the sliding plate due to high temperatures.

In the case of E, however, since that is a leakage of high-temperature gases, the transverse sealing member S of right angle cross-section shown in FIG. 3 is likely to suffer abrasion or the break-away of heat resisting layer.

The present invention serves to prevent such damage to the transverse sealing member S. This is done by reducing abrasion or break-away of material by cooling the sliding plate 14 with a current of relatively low-temperature air. The same air can be utilized to cool shield panel 16 and backing plate 18, which are exposed to considerable heat.

Figure 6:
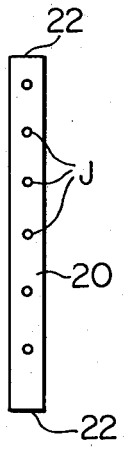
FIGS. 4 to 6 show a preferred embodiment of the present invention, FIG. 4 being a plan view of a sealing member in which a shield panel and a backing plate are taken out, FIG. 5 being an enlarged cross section of a cover of FIG. 4, and FIG. 6 being a side view of the cover of FIG. 4.
Figure 4:
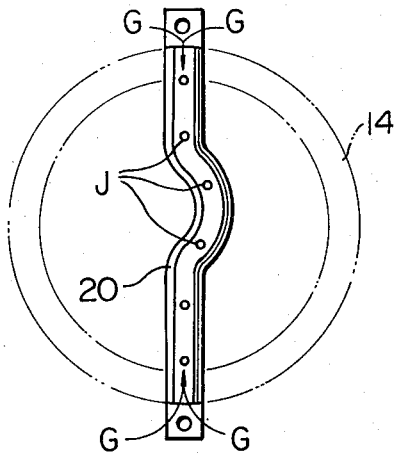
Figure 5:
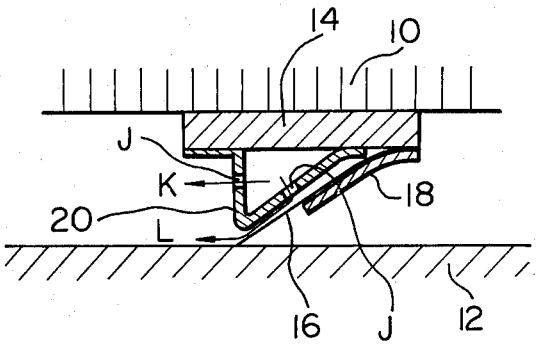

Conventional sealing means are composed of only a sliding plate, a shield panel and a backing plate. The present invention, however, calls for attaching cover 20, which forms a hollow triangle in cross-section defining an interior chamber and has openings at each of its ends, to sliding plate 14 as shown in FIGS. 4 to 6. Cover 20 has several holes J in the side parallel to the heat exchanger axis and the oblique side of its cross-sectional triangle, through which low-temperature air G is forced to flow under pressure in the directions shown by arrows K and L.

Theoretically, by forming a passage for air in the form of holes J in cover 20, the present invention provides for leading, low-temperature air under pressure to the exterior of heat accumulator 10 for the purpose of pressurizing the exterior of heat accumulator 10, thereby preventing damage caused by a flow of heat due to the interior gas pressure being higher than that on the exterior. For this purpose, low-temperature air under pressure, G is fed in through openings at both ends 22 of cover 20 illustrated in FIG. 4. Since the pressure of the heat exchanger output high-temperature air is lower than the pressure of the inlet low-temperature air G entering the ends of the cover 20 by the margin of pressure loss delta P occuring between air input to and output from heat exchanger 10 (see FIG. 1), the low-temperature fluid can be introduced merely by cutting holes in cover 20.

Since the flow through these holes J does not constitute a loss by leakage from high-pressure air G to low-pressure gases I, but simply means that part of the air bypasses the process of being heated in heat accumulator 10, the total volume of pressurized fluid G entering the heat exchanger proper is not altered. Nor are the heat exchange efficiency and the pressure drop influenced by the leakage into member J since the amount of this leakage is very slight.

With regard to the heat exchange efficiency, the temperature resulting from the mixture of air passed through the heat accumulator and the leaked air which bypasses the heat accumulator is almost identical with the temperature for a conventional design, since, as the volume of air passing through the heat accumulator is decreased by the said leakage, the temperature of the outflowing air is consequently increased.

The pressure drop is little altered, since an increased pressure drop caused by a decrease in the amount of air passing through the heat accumulator is offset by a pressure loss increase resulting from increasing temperature rise of the said decreased amount of air at the time of passage.

Thus, the present invention is intended to cool the sealing means composed of a sliding plate, a shield panel and a backing plate by attaching a cover pierced with holes to the sealing member of the high-pressure side of the heat accumulator. The sealing member is designed to separate high-temperature, high-pressure air from high-temperature, but low-pressure gases. Further comparatively low-temperature, but high-pressure air is led through the holes of the cover into the high temperature, high pressure air by virtue of a difference in pressure caused by the passage of the air through the heat accumulator. The effect of the present invention is to prevent the abrasion of sliding parts, the break-away of a heat resisting layer and loss of structural strength in those parts due to high temperatures.

What is claimed is:

1. In a sealing member for a rotary heat-accumulator type heat exchanger of a gas turbine engine which sealing member includes a sliding plate slidable on a heat accumulator, a shield panel secured to said sliding plate, and a backing plate for backing said shield panel, said shield panel having a low-temperature side and a high-temperature side, the improvement comprising:

a. an elongate cover defining an interior chamber therethrough constituting a flow path for low-temperature air, b. said cover extending along the sliding plate and being disposed between said sliding plate and said shield panel at the low-temperature side of the shield panel, c. said cover extending radially of said heat accumulator and having openings at each end thereof to admit low-temperature and high-pressure air to the interior chamber of said cover and having a plurality of holes such that said air will cool portions of said sealing member.

2. The improvement according to claim 1, in which said cover is formed in a hollow triangular cross-sectional shape including a side wall parallel to an axis of said heat accumulator and an oblique portion integral with said side wall.

3. The improvement according to claim 2, in which said plurality of holes are formed in said side wall and oblique portion of said cover.

4. In a sealing member for a rotary heat-accumulator type heat exchanger of a gas turbine engine, which sealing member includes a sliding plate slidable on a heat accumulator, a shield panel secured to the sliding plate, and a backing plate for backing the shield panel, the improvement comprising:

a. a cover extending along the sliding plate and being disposed between said sliding plate and said shield panel, b. said cover having an interior chamber and a plurality of holes, and c. means for direction low-temperature, high pressure air in a forced flow to the interior chamber of said cover outwardly through said holes to the exterior of said heat accumulator for thereby cooling portions of said sealing member.

5. The improvement according to claim 4, in which said cover extends radially of said heat accumulator and said directly means includes openings at each of the ends of said cover to admit low-temperature, high pressure air to the interior said cover.

6. The improvement according to claim 4, in which said cover is formed in a hollow triangular cross-sectional shape including a side wall parallel to an axis of said heat accumulator and an oblique portion integral with said side wall.

7. The improvement according to claim 6, in which said plurality of holes are formed in said side wall and oblique portion of said cover.

* * * * *